US010538375B2

(12) United States Patent
Bech

(10) Patent No.: US 10,538,375 B2
(45) Date of Patent: Jan. 21, 2020

(54) CONTAINER FOR FLUIDS

(71) Applicant: KONTORPARK APS I LIKVIDATION, Hornbaek (DK)

(72) Inventor: Frans Bech, Hornbaek (DK)

(73) Assignee: KONTORPARK APS I LIKVIDATION, Hornbaek (DK)

( * ) Notice: Subject to any disclaimer, the term of this patent is extended or adjusted under 35 U.S.C. 154(b) by 35 days.

(21) Appl. No.: 15/502,407

(22) PCT Filed: Aug. 7, 2015

(86) PCT No.: PCT/EP2015/068268

§ 371 (c)(1),
(2) Date: Feb. 7, 2017

(87) PCT Pub. No.: WO2016/020529

PCT Pub. Date: Feb. 11, 2016

(65) Prior Publication Data

US 2017/0240330 A1 Aug. 24, 2017

(30) Foreign Application Priority Data

Aug. 8, 2014 (DK) ..... 2014 70477

(51) Int. Cl.
*B65D 47/20* (2006.01)
*B65D 75/58* (2006.01)
(Continued)

(52) U.S. Cl.
CPC ..... *B65D 75/5811* (2013.01); *B65D 33/30* (2013.01); *B65D 35/46* (2013.01);
(Continued)

(58) Field of Classification Search
CPC ..... B65D 33/16; B65D 33/30; B65D 35/46; B65D 47/2018; B65D 47/20; B65D 47/2031; B65D 47/2037
USPC ..... 222/212–214, 494–496, 491, 92, 107, 222/490; 383/43, 44, 46–49, 68, 35, 906; 150/150, 151, 900
See application file for complete search history.

(56) References Cited

U.S. PATENT DOCUMENTS 3,263,903 A 8/1966 Waller et al.
3,297,152 A 1/1967 Corella et al.
(Continued)

FOREIGN PATENT DOCUMENTS

CH 407725 A 4/1964
DE 3418597 A1 11/1984
(Continued)

OTHER PUBLICATIONS

International Search Report and Written Opinion; International Application No. PCT/EP2015/068268; International Searching Authority; dated Nov. 9, 2015.

*Primary Examiner* — Jes F Pascua
*Assistant Examiner* — Nina K Attel
(74) *Attorney, Agent, or Firm* — Mollborn Patents, Inc.; Fredrik Mollborn

(57) ABSTRACT

A container comprising a first layer of sheet material defining a compartment for holding a fluid material, first and second peripheral edges defining lateral boundaries of the compartment, a first end defining an opening end and a channel having a first cross sectional diameter extending into the compartment between the peripheral edges, a second end defining a bottom of the compartment, a valve comprising a first layer of flexible material of higher stiffness than the sheet material on a first side of the channel, a valve positioned on a second side of the channel, where the first layer and the valve are joined on opposite sides of the channel via attachment means restricting the first cross sectional diameter of the channel where a deflection of the flexible material in a direction substantially perpendicular to the longitudinal axis provides increased resistance to deflection in the direction along the longitudinal axis.

11 Claims, 8 Drawing Sheets

(51) Int. Cl.

| | |
|---|---|
| ***B65D 75/00*** | (2006.01) |
| ***B65D 33/30*** | (2006.01) |
| ***B65D 35/46*** | (2006.01) |
| ***B65D 85/72*** | (2006.01) |

(52) U.S. Cl.
CPC ..... *B65D 75/008* (2013.01); *B65D 75/58* (2013.01); *B65D 75/5816* (2013.01); *B65D 85/72* (2013.01)

(56) References Cited

U.S. PATENT DOCUMENTS

| | | | | |
|---|---|---|---|---|
| 4,027,819 | A | 6/1977 | Herrera-Gutierrez | |
| 4,252,257 | A * | 2/1981 | Herzig ..... | B65D 47/2031 222/213 |
| 7,004,354 | B2 * | 2/2006 | Harper ..... | B65D 75/30 222/212 |
| 2002/0088825 | A1 * | 7/2002 | Laverdure ..... | B65D 33/1658 222/107 |
| 2009/0266036 | A1 | 10/2009 | Zerfas et al. | |

FOREIGN PATENT DOCUMENTS

| | | | |
|---|---|---|---|
| EP | 1162152 | A1 | 12/2001 |
| EP | 1714892 | A2 | 10/2006 |
| EP | 2684812 | A1 | 1/2014 |
| JP | 2004035013 | A | 2/2004 |
| JP | 2011073682 | A2 | 4/2011 |
| WO | 8706558 | | 11/1987 |

* cited by examiner

CONTAINER FOR FLUIDS

BACKGROUND

Such receptacles are commonly known and widely used for holding and/or storing substances such as fluids or liquids of all kinds, but particularly foodstuffs, cosmetics or body care products.

DE 34 18 597 A1 describes a bag of the above-mentioned kind and comprising a valve that has two valve flaps forming pouches between the outside sheets and the valve flaps. The valve flaps are attached by transverse welds to the respective insides of their channel. The pouches are open in the direction of the interior of the bag. The outside sheets and the valve flaps are welded to each other along two longitudinal welds so that a narrow tubular inner inlet and inner pouches are formed on each side of the inner inlet in the lower region of the inlet. The inner pouches remain expanded due to the entry of air from the flat bag, so that when liquid flows back it can enter the inner pouches and, from there, over the inner tubular inlet, thereby squeezing together and sealing the inlet. In other words, liquid cannot exit the bag once it is filled into the interior of the bag.

In very many situations, however, a user would at some point desire to retrieve the liquid contained in the receptacle such as to use the liquid in an intended manner. A wide variety of uses is of course feasible depending on the type and nature of the liquid. In such situations the bag according to DE 34 18 597 A1 is disadvantageous in that retrieval of the liquid contained in the bag is not possible unless the bag is torn open, in which case the risk of spilling the liquid is very high.

An attempt at a solution is described in EP 1 162 152 A1 which concerns a bag container with a cylindrical, rigid check valve attached to the bag container by means of a combination of heat shrinking and gluing. This valve solution is however expensive to manufacture due to both the complicated structure of the check valve and the complicated procedure to be used to attach the valve to the bag container. Furthermore, due to the check valve, such a bag container takes up much space during storage and transport, especially when it is empty and is heavy. Also, due to the position of the check valve, such a bag container requires a separate lid to prevent spilling and particularly to keep the valve sanitary during transport and storage of the container.

SUMMARY

In accordance with the invention, there is provided a container comprising a first layer of sheet material defining a compartment for holding a fluid material, a first peripheral edge for defining a first lateral boundary of the compartment, a second peripheral edge for defining a second lateral boundary of the container, a first end comprising an area defining an opening end and a channel having a first cross sectional diameter extending along a longitudinal axis into the compartment between the first peripheral edge and the second peripheral edge, a second end adapted to be closed defining a bottom of the compartment, a valve means for providing an automatic liquid stop for the opening into the compartment where the valve means comprises a first layer of flexible material on a first side of channel where the flexible material comprises a material that has a higher stiffness than the sheet material defining the compartment, a valve element positioned on a second side of the channel to provide an opposing force to the first layer, where the first and the valve element are joined on opposite sides of the channel via a first and a second attachment means that is adapted to restrict the first cross sectional diameter of the channel where a deflection of the flexible material in a direction substantially perpendicular to the longitudinal axis provides increased resistance to deflection in the direction along the longitudinal axis, so that the deflection in the first layer provides pressure towards the valve element to prevent fluid communication from the compartment to the opening end.

By providing a flexible layer that may be seen as directional, where a deflection in the material along one axis increases the rigidity of the deflected area in the direction of the deflection, it is possible to increase the rigidness of the material, and where the deflected portion of the material (in the same direction as the bend) is substantially along a straight line. Thus the deflection of the material, by bending the plane of the material, the bottom of the plane will have an increased rigidness, and forces transferred to the layer will assist the layer from resisting bending forces in a different direction. Thus the bottom of the deflection will abut the valve element, and force the layers of sheet material together and close off the cross section of the channel together and keep prevent channel to open and provide fluid communication to the compartment.

The valve element may be formed of a material that is adapted to maintain a planar surface in the direction of the deflection (bend) so that it provides an opposing planar surface to the first layer when the first layer is deflected.

In one embodiment, the channel may be provided between the first layer and valve element. Thus, the channel formed in the sheet material may be positioned so that the first layer and the valve element surround the channel, and where the entire channel may pass through the first layer and the valve element.

In one embodiment, the attachment means may be in the form of a weld, an adhesion or a clamp. The attachment may be done in any suitable manner, where it may be advantageous that the attachment reduces the maximum cross sectional diameter of a part of the channel, where the attachment means directs the fluid through a specific area when the fluid is being led from the compartment and out of the opening.

In one embodiment, wherein the attachment means may provide an increased strength and/or stiffness to the first and second flexible materials. By increasing the strength and/or stiffness of the flexible material of the valve, it is possible to provide a further means for preventing the flexible material from bending in a direction orthogonal to the deformation, and thereby increasing the rigidity of the flexible material when it is deformed.

In one embodiment, the first and second flexible material may overlap each other and are substantially parallel when the container is empty. Thus, the first and the second flexible materials overlap each other on opposite sides of the sheet material defining the channel and/or the compartment of the container, which allows the layers of flexible material to abut the outer surfaces of the sheet material and where the sheet material is sandwiched between the two layers of sheet material.

In one embodiment, the valve element may comprise a second layer of flexible material positioned on a second side of the channel. Thus it may be possible to provide a valve mechanism that functions on two sides of the channel.

In one embodiment of the invention, the deflection area of the first flexible material and/or the second flexible material providing the increased resistance may be proximal to attachment means in a direction towards the second end of the container. Thus, by deflecting the part of flexible material facing the second end of the container, the content of the compartment may force the flexible material to deflect. Thus, in order to remove the deflection, the user may need to force the part of the flexible material overlapping the container in a direction towards the longitudinal axis by pressing the contents of the container. In one embodiment, the peripheral edges of the container may be adapted to be angled toward each other, where the angle is converging towards the first end of the container.

In one embodiment the attachment means may be at an angle respective to the direction of deflection of the first layer.

In one embodiment, the flexible layer may be made of a polyester, polyethylene, polypropylene, PVC, a multi layered film, or similar polymeric films, that is approximately between 60-100 g/m$^2$, and more preferably about 80 g/m$^2$, where the material is preferably more rigid than the sheet material of the container and may be polymeric stabilized or highly stabilized. The thickness of the film may be between 50-250 μm, where it is especially advantageous to use a material having a thickness of 100 μm-125 μm. In specific embodiments the film of the type ImageLast Laminating pouches, Capture 125 (125 μm) or 100 (100 μm), model number 53693 made available by Fellowes UK, Yorkshire Way, West Moor Park, Doncaster DN3, 3FB, England.

The sheet material of the container may be made of an LDPE, having a thickness of between 30-60 μm, where it is especially advantageous to use a thickness of 40 μm.

The opening of the first end may be arranged in such a way that the ration between the width of the opening and one restriction in the opening using the attachment means is between 20:1 and 4:1, so that when opposite attachment means are used the total restriction ratio is between 10:1 and 2:1 as the attachment means are positioned on opposite peripheral sides of the opening. Thus, as an example if the ratio is 10:1, the width of the opening may be 2.5 cm, while the width of the attachment means may be 2.5 mm on each side of the opening, so that the opening is restricted by a total of approximately 5 mm. More specifically the ratio may be approximately between 15:1 and 5:1 or more specifically between 10:1 and 6:1, or even more specifically about 7:1. The ratio 7:1 has been utilized in the embodiment shown in FIG. 11, where the ratio 4:1 has been used on the embodiment shown in FIG. 6.

In one embodiment of the invention, a distal end of the material is adapted to extend in a longitudinal direction from the area of the opening and onto the sheet material defining the compartment. Thus, when the compartment is filled with a fluid, the distal end of the material is raised from the radial position of the opening and moved in a radial direction from the longitudinal axis, causing the flexible material to deform.

In one embodiment of the invention, the first flexible material and/or the second flexible material may have a varying thickness in a direction along the longitudinal axis of the container. By having varying thickness of the material, it may be possible to provide increased control of the opening of the valve means as an increase in thickness in the area, where pressure is provided to the opposing valve element, may ensure that the valve means is maintained in its closed position for a longer period, while deflecting the flexible material in the same manner, compared to a single thickness. The vice versa is also possible, where it may be advantageous to have a valve means that is easy to open. This way, the thickness of the material, where the pressure is provided, may be decreased, thus ensuring that the deflection of the material ensures that the resistance perpendicular to the longitudinal axis is reduced.

In one embodiment of the invention, the thickness of the first flexible material and/or the second flexible material may be greater in the area where the pressure is provided against the valve element and/or the opposing flexible material to prevent fluid communication between the compartment and the opening end. By having varying thickness of the material, it may be possible to reduce the force necessary to deform the flexible material by having the material to be deformed thinner, while still maintaining a reliable seal across the valve element as the thicker material maintains its shape for a longer period across the sealed valve. In accordance with the invention, the term receptacle is synonymous with the term container, where the meaning of the terms is to indicate anything that can contain something, such as a bottle, bag, etc.

BRIEF DESCRIPTION OF DRAWINGS

The invention is explained in detail below with reference to the drawings, in which.

DETAILED DESCRIPTION

Figure 1:
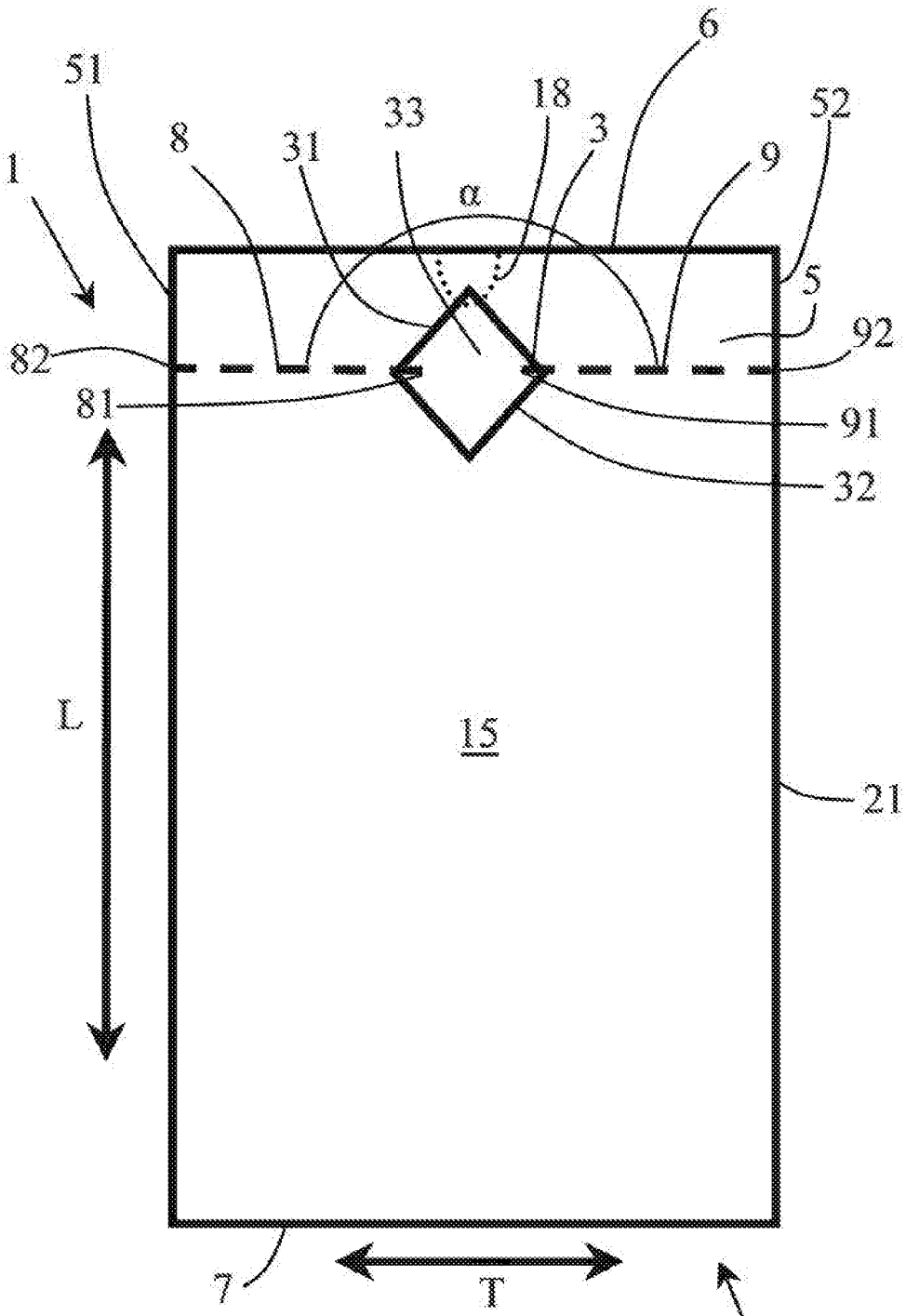
FIG. 1 shows a side view seen from above of a first embodiment of a receptacle according to the invention.

The receptacle body 2 generally comprises a first layer of plastic foil 21, a longitudinal direction indicated by an arrow L, a transversal direction indicated by an arrow T, an internal chamber 15 and an outlet section 5.

The receptacle body 2 further comprises an edge 6 forming an edge of the outlet section 5 opposite the internal chamber 15 and a first and a second side edge 51 and 52, respectively, forming mutually opposite side edges of the outlet section 5.

In the embodiment shown in FIG. 1, the receptacle body 2 further comprises a tamper evident feature in the form of a section 18 which is adapted for being torn or cut from the remaining receptacle body 2 such as to enable a user to open the receptacle 1 in such a way as to form an opening extending between the valve body 3 and the first edge 6. The receptacle 1 is thus normally closed at the edge 6 of the outlet section 5. The section 18 may for instance be made of a different material than the remaining receptacle body 2 or it may be marked e.g. by means of perforations forming a tear line or markings indicating a cutting line. It is noted that irrespective of the embodiment the provision of such a section 18 is optional.

The first layer of plastic foil 21 of the receptacle body 2 may be provided as a U shaped or tubular plastic foil with closed sides, an open end and a closed end, where the closed end corresponds to the edge 6 and the open end corresponds to the bottom edge 7, which then may be closed by means of a sealing (not shown), or vice versa. The first layer of plastic foil 21 of the receptacle body 2 may also be provided as two sheets of plastic foil joined by means of mutually opposite side sealings as described further below.

The valve body 3 is, when seen in the transversal direction T, arranged at the outlet section 5 and substantially centrally on the receptacle body 2 at the outlet section 5. More generally, the valve body 3 is arranged in a distance from both the first side edge 51 and the second side edge 52 of the outlet section 5. The valve body 3 comprises two opposite sides 31 and 32. In the embodiment shown the valve body 3 is arranged spaced apart from the edge 6 of the outlet section 5 such that when the section 18 is removed by a user a connection between the edge 6 and the valve body 3 is formed.

The valve body 3 generally comprises a higher stiffness than the receptacle body 2. The valve body 3 also generally comprises a first element of plastic foil 33 and a second element 34 (not visible on FIGS. 1-4, but cf. FIG. 5) of plastic foil attached to the receptacle body 2 by means of two sealings 8 and 9. More particularly, the first element of plastic foil 33 and the second element of plastic foil 34 comprise a higher stiffness than the first layer of plastic foil 21 of the receptacle body. The first element of plastic foil 33 and the second element of plastic foil 34 are attached to an outer side of the receptacle body 2. The first element of plastic foil 33 and the second element of plastic foil 34 are more particularly attached to the first layer 21 of plastic foil. In principle, the first element of plastic foil 33 and the second element of plastic foil 34 may also be attached to an inner side of the receptacle body 2.

The first element of plastic foil 33 and the second element of plastic foil 34 are advantageously of the same size and shape.

The first element of plastic foil 33 and the second element of plastic foil 34 are arranged such as to overlap substantially completely. In other embodiments the first element of plastic foil 33 and the second element of plastic foil 34 may be arranged such as to overlap partially.

The valve body 3 is adapted such that it comprises an open state and a closed state. More specifically, the valve body closes off the access to the internal chamber 15 of the receptacle body 2 in the closed state and allows a substance (not shown) contained in the internal chamber 15 to exit the receptacle 1 in the open state. The valve body 3 is also adapted such that it is stable in both the open state and the closed state. The function of the valve body 3 and the receptacle 2 will be described in details below with reference to FIGS. 4 and 5.

In the embodiment shown in FIG. 1, the valve body 3 has the surface shape of a diamond. The valve body may, however, have any suitable surface shape such as e.g. triangular, rhombic, square, rectangular, circular, oval and/or any combination thereof.

Generally and irrespective of the embodiment, the two sealings 8 and 9 each comprises a first end 81 and 91, respectively, and a second end 82 and 92, respectively, and the respective first ends 81 and 91 of the two sealings 8 and 9 are located farther or in the same distance from the edge 6 of the outlet section 5 than or as the respective second ends 82 and 92 and the distance between the two sealings 8 and 9 measured between the respective first ends 81, 91 is smaller than or equal to the distance between the two sealings 8 and 9 measured between the respective second ends 82 and 92.

In the embodiment shown in FIG. 1, the respective first ends 81 and 91 of the two sealings 8 and 9 are located in the same distance from the edge 6 of the outlet section 5 as the respective second ends 82 and 92. More precisely, the first end 81 of the sealing 8 is arranged at the side 31 of the valve body and the second end 82 of the sealing 8 is arranged at a position on the receptacle body 2, and the first end 91 of the sealing 9 is arranged at the opposite side 32 of the valve body 3 and the second end 92 of the sealing 9 is arranged at a position on the receptacle body 2, such that the respective first ends 81, 91 and the respective second ends 82, 92 are arranged on one and the same straight line.

Put in other words, in the embodiment shown in FIG. 1, the angle $\alpha$ between the two sealings 8 and 9 is 180°.

In the embodiment shown on FIG. 1, the two sealings 8, 9 extend from the two opposite sides 31 and 32 of the valve body 3 and close the internal chamber 15 of the receptacle body 2 in such a way the valve body 3 provides the only access to the internal chamber 15 of the receptacle body 2.

Figure 2:
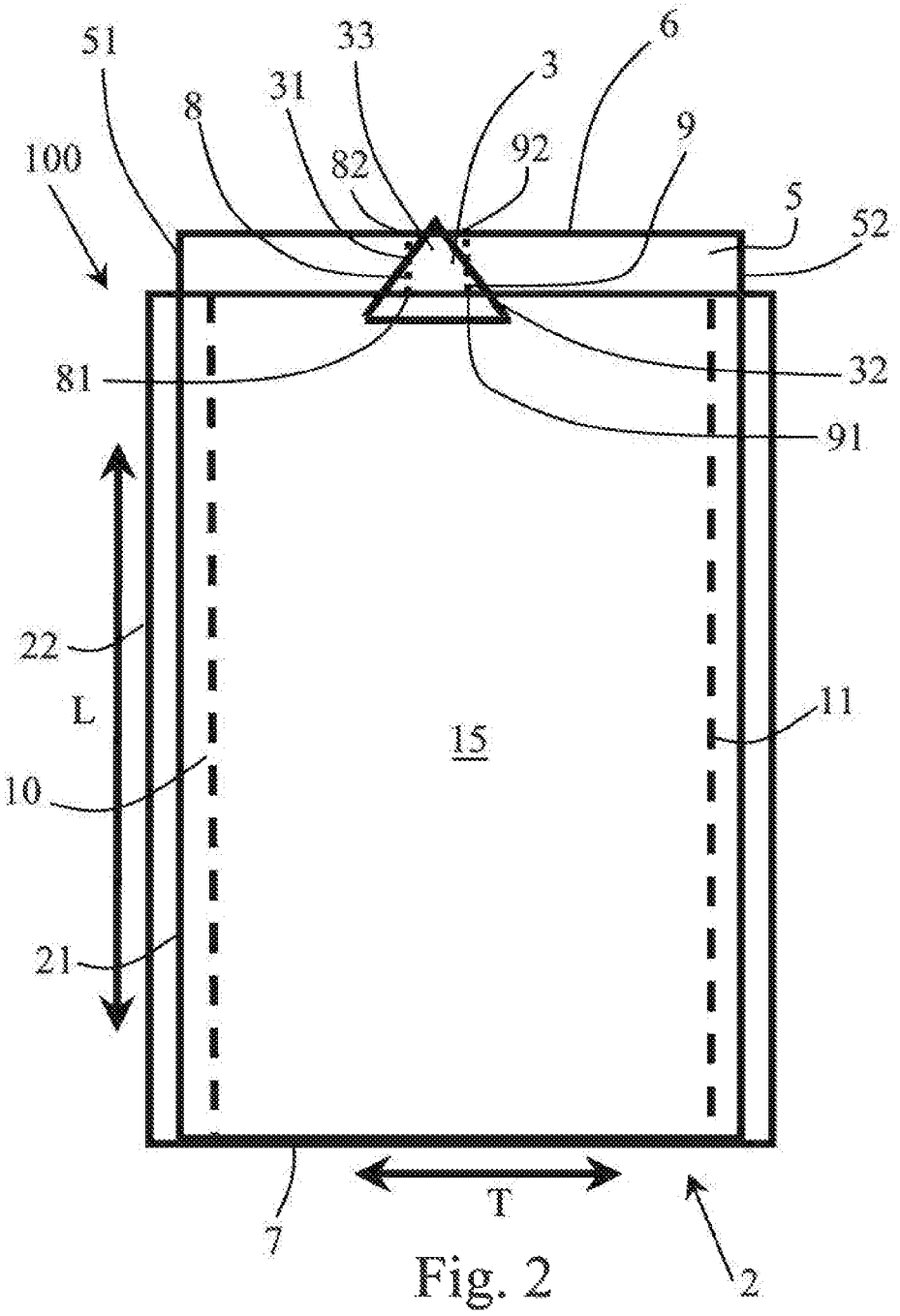
FIG. 2 shows a side view seen from above of a second embodiment of a receptacle according to the invention.

Turning now to FIG. 2, a second embodiment of a receptacle 100 according to the invention is shown. The receptacle 100 will be described only with respect to the points on which it differs from the receptacle shown in FIG. 1 and described above.

First of all, the receptacle body 2 of the receptacle 100 comprises a second layer of plastic foil 22. The second layer of plastic foil 22 forms an outer layer of the receptacle body 2, while the first layer of plastic foil 21 forms an inner layer of the receptacle body 2. The second layer of plastic foil 22 comprises a higher stiffness than the first layer of plastic foil 21.

In this embodiment, the valve body 3 comprises a higher stiffness than both the first layer of plastic foil 21 and the second layer of plastic foil 22 of the receptacle body 2. As shown the valve body 3 is provided with a surface in the shape of a triangle which is, but need not necessarily be, isosceles, and which is oriented with its top facing towards the first edge 6.

The valve body is furthermore arranged such that it extends partially beyond the edge 6.

Furthermore, the two sealings 8, 9 extend in an angle $\alpha$ of 0° with respect to one another. In other words the two sealings 8 and 9 are parallel. Thus, the distance between the two sealings 8, 9 measured between the respective first ends 81, 91 is equal to the distance between the two sealings 8, 9 measured between the respective second ends 82, 92. In the embodiment shown on FIG. 2 the two sealings 8, 9 extend from the valve body 3, crossing the two opposite sides 31 and 32 of the valve body 3 and to the edge 6. More precisely, the first end 81 of the sealing 8 is arranged at a position on the valve body 3 and the second end 82 of the sealing 8 is arranged at the edge 6, such that the sealing 8 crosses the side 31 of the valve body. Likewise, the first end 91 of the sealing 9 is arranged at a position on the valve body 3 and the second end 92 of the sealing 9 is arranged at the edge 6, such that the sealing 9 crosses the side 32 of the valve body 3.

Also, the receptacle body comprises two side sealings 10 and 11. The side sealings 10 and 11 extend in the embodiment shown from the outlet section 5 to the second edge 2 of the receptacle body. The side sealings 10 and 11 serve to attach the first layer of plastic foil 21 and the second layer of plastic foil 22 to one another. In some embodiments the side sealings 10 and 11 may also serve to close the sides of the receptacle body. The valve body 3 is arranged in a distance from both side sealings 10 and 11.

Figure 3:
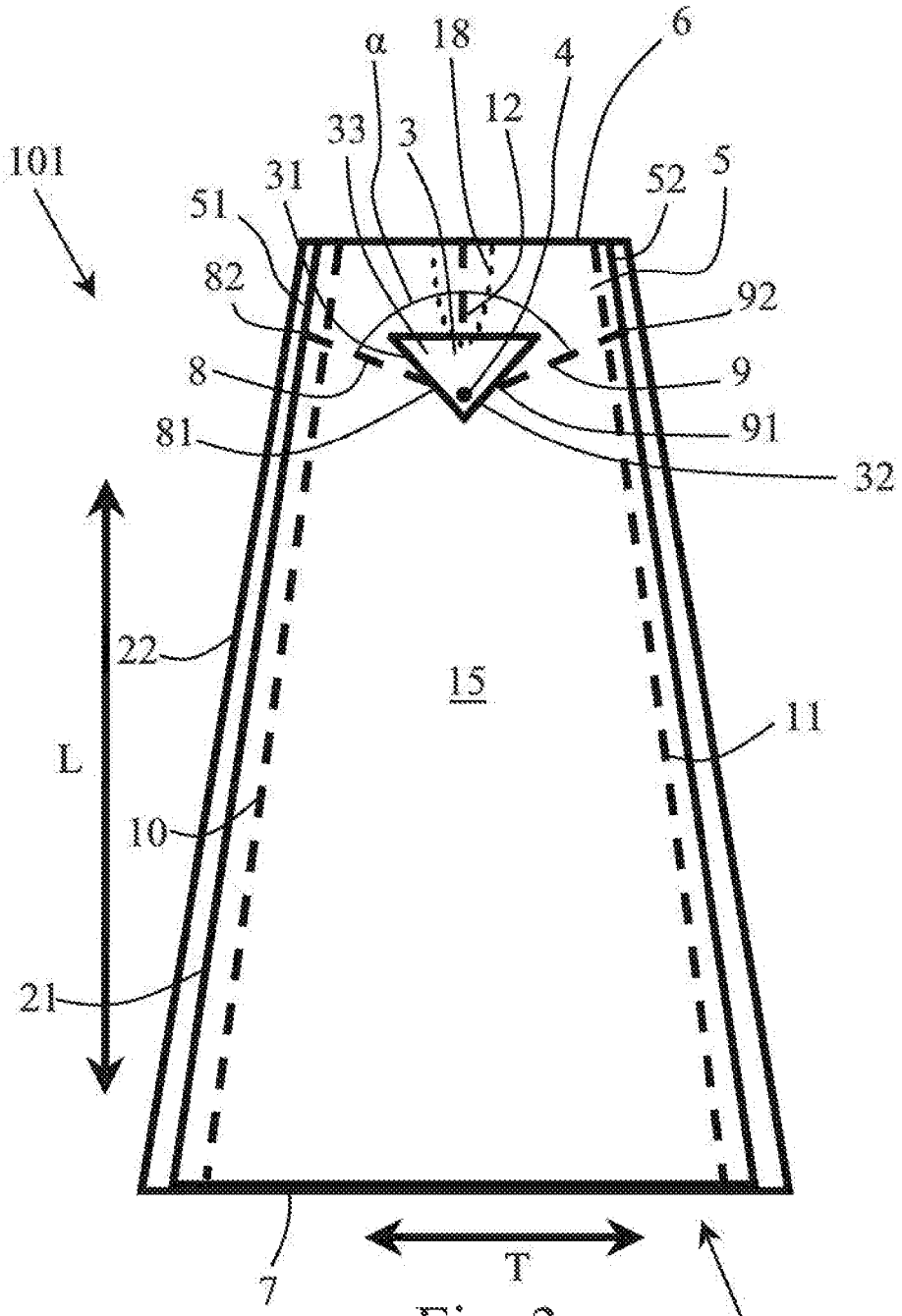
FIG. 3 shows a side view seen from above of a third embodiment of a receptacle according to the invention.

Turning now to FIG. 3, a third embodiment of a receptacle 101 according to the invention is shown. The receptacle 101 will be described only with respect to the points on which it differs from the receptacle shown in FIG. 1 and described above.

First of all, the receptacle body 2 of the receptacle 101 comprises a second layer of plastic foil 22. The second layer of plastic foil 22 forms an outer layer of the receptacle body 2, while the first layer of plastic foil 21 forms an inner layer of the receptacle body 2. The second layer of plastic foil 22 comprises a higher stiffness than the first layer of plastic foil 21. The receptacle body 2, and particularly the outlet section 5, of the receptacle 101 is tapered in the longitudinal direction L towards the edge 6. In principle only the outlet section 5 may be tapered, while the remaining part of the receptacle body 2 may take up any feasible shape.

In this embodiment, the valve body 3 comprises a higher stiffness than both the first layer of plastic foil 21 and the second layer of plastic foil 22 of the receptacle body 2. As shown the valve body 3 is provided with a surface the shape of a triangle which is, but need not necessarily be, isosceles, and which is oriented with its top facing away from the first edge 6.

Also, the receptacle body comprises two side sealings 10 and 11. The side sealings 10 and 11 extend in the embodiment shown from the outlet section 5 to the second edge 2 of the receptacle body. The side sealings 10 and 11 serve to attach the first layer of plastic foil 21 and the second layer of plastic foil 22 to one another. The valve body 3 is arranged in a distance from both side sealings 10 and 11.

The two sealings 8, 9 extend in an angle $\alpha$ of about 120° with respect to one another. Thus, the distance between the two sealings 8, 9 measured between the respective first ends 81, 91 is smaller than the distance between the two sealings 8, 9 measured between the respective second ends 82, 92. In the embodiment shown on FIG. 3 the two sealings 8, 9 extend from the two opposite sides 31 and 32 of the valve body 3 towards and beyond the respective side sealings 10 and 11. More precisely, the first end 81 of the sealing 8 is arranged at the side 31 of the valve body and the second end 82 of the sealing 8 is arranged at a position on the opposite side of the side sealing 10 to the valve body 3. Likewise, the first end 91 of the sealing 9 is arranged at the opposite side 32 of the valve body 3 and the second end 92 of the sealing 9 is arranged at a position on the opposite side of the side sealing 11 to the valve body 3.

Alternatively, the two sealings 8, 9 may extend from the two opposite sides 31 and 32 of the valve body 3 to the respective side sealings 10 and 11, or even only part of the way to the respective side sealings 10 and 11.

Furthermore, the receptacle body 2 of the receptacle 101 is provided with a further sealing 12 extending from the valve body 3 towards—and here all the way to—the edge 6 of the outlet section 5. In the embodiment shown the further sealing 12 is provided on the tearable or cuttable section 18. However, the further sealing 12 may just as well be provided on another part of the receptacle body 2. It is noted that the further sealing 12 is a purely optional feature.

Also, the receptacle 101 comprises a locking mechanism 4 adapted for locking the valve body in its open position. The locking mechanism 4 is arranged at a position on the valve body 3 at which a user should press on the valve body in order to force it into its open position. It is noted that irrespective of the embodiment the provision of a locking mechanism 4 is optional. In embodiments not having such a locking mechanism, such as the embodiments shown in FIGS. 1 and 2, a marking indicating position on the valve body 3 at which a user should press on the valve body in order to force it into its open position may be provided for easy use of the receptacle.

The receptacles shown in FIGS. 1 to 3 are all suitable for being provided in the form of a bag, a pouch or a sachet of the type intended for storage in a lying position.

Figure 4:
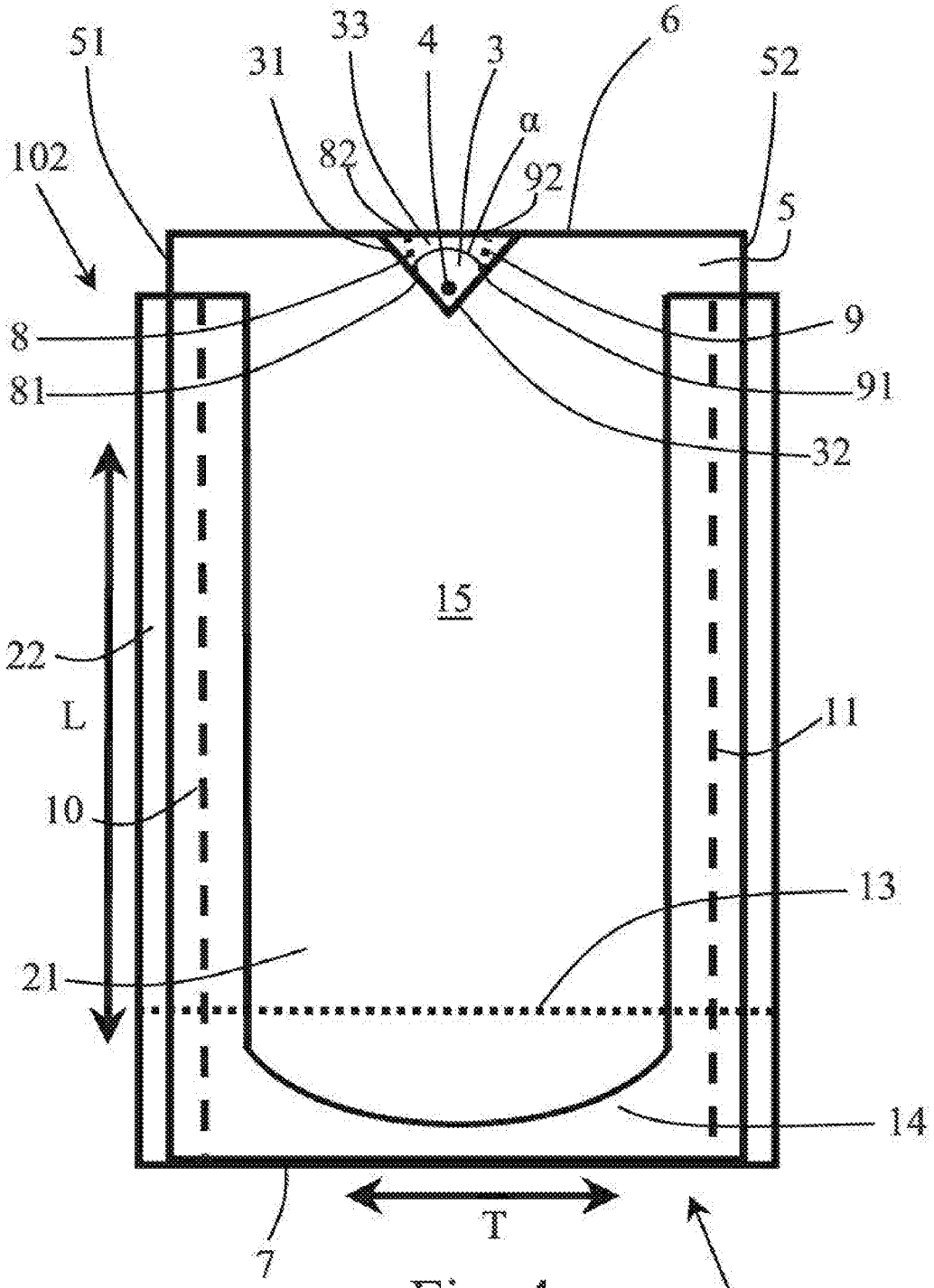
FIG. 4 shows a side view seen from above of a fourth embodiment of a receptacle according to the invention, the valve body being in a closed state.
Figure 5:
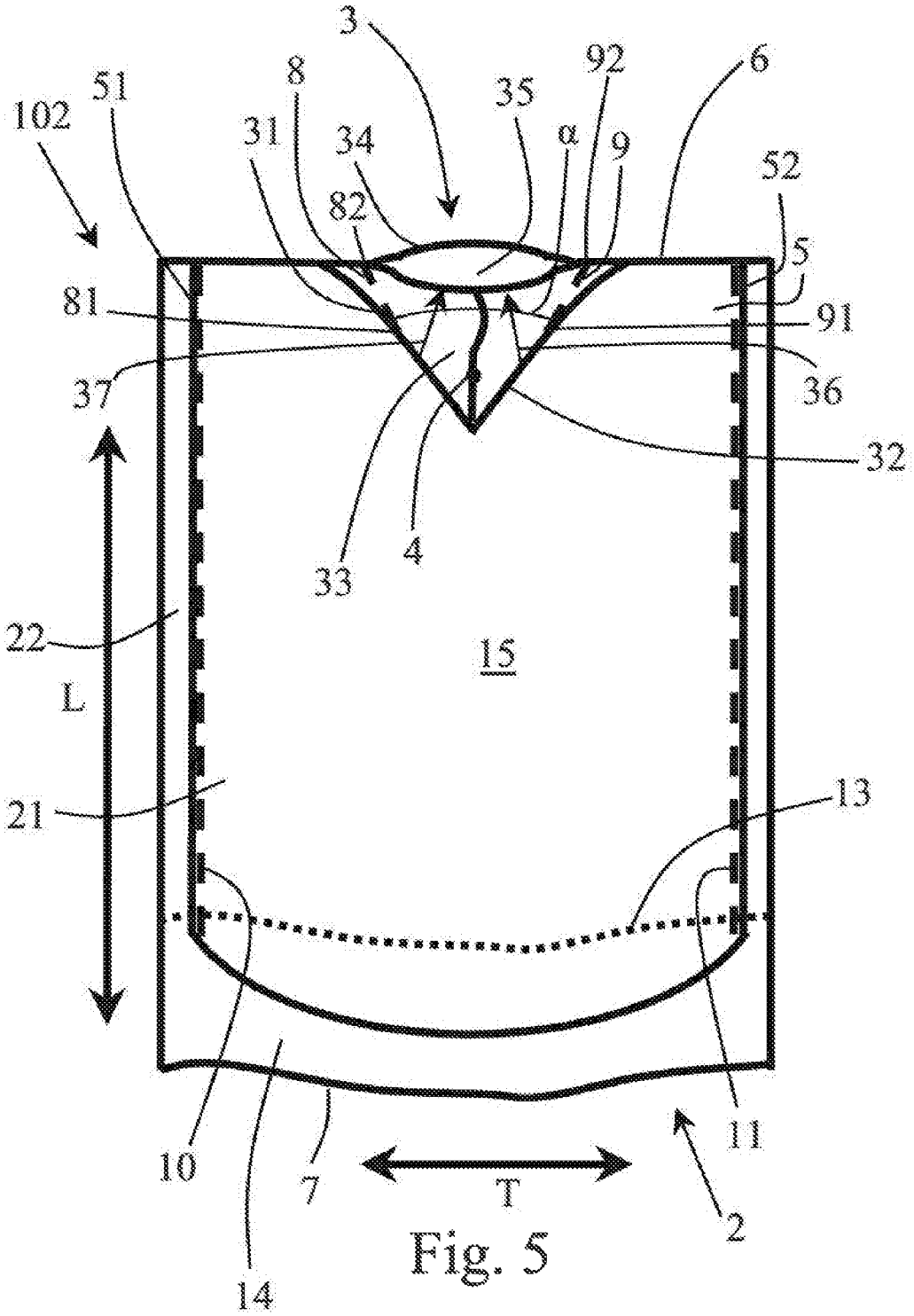
FIG. 5 shows a perspective side view of the receptacle according to FIG. 4, the valve body being in an open state.

Turning now to FIGS. 4 and 5 a fourth embodiment of a receptacle 102 according to the invention is shown. The receptacle 102 will be described only with respect to the points on which it differs from the receptacle shown in FIG. 1 and described above.

In FIG. 4, the receptacle 102 is shown in a side view seen from above with the valve body 3 in its closed position. In FIG. 5 the receptacle 102 is shown in a perspective side view with the valve body 3 in its open position.

First of all, the receptacle body 2 of the receptacle 102 comprises a second layer of plastic foil 22. The second layer of plastic foil 22 forms an outer layer of the receptacle body 2, while the first layer of plastic foil 21 forms an inner layer of the receptacle body 2. The second layer of plastic foil 22 comprises a higher stiffness than the first layer of plastic foil 21. In this embodiment the valve body 3 comprises a higher stiffness than both the first layer of plastic foil 21 and the second layer of plastic foil 22 of the receptacle body 2. As shown the valve body 3 is provided with a surface in the shape of a triangle which is, but need not necessarily be, isosceles, and which is oriented with its top facing away from the first edge 6.

The valve body 3 comprises a first element of plastic foil 33 and a second element of plastic foil 34 (visible on FIG. 5) that are arranged on mutually opposite sides of the receptacle body 2 as described above.

The valve body 3 is furthermore arranged such that the side of the valve body 3 extending between the two opposite sides 31 and 32 is substantially flush with the edge 6.

Furthermore, the two sealings 8, 9 extend in an angle $\alpha$ of about 20° with respect to one another. Thus, the distance between the two sealings 8, 9 measured between the respective first ends 81, 91 is smaller than the distance between the two sealings 8, 9 measured between the respective second ends 82, 92. In the embodiment shown on FIG. 1 the two sealings 8, 9 extend on the valve body 3 from the two opposite sides 31 and 32 of the valve body 3 to the edge 6. More precisely, the first end 81 of the sealing 8 is arranged at the side 31 of the valve body and the second end 82 of the sealing 8 is arranged at the edge 6. Likewise, the first end 91 of the sealing 9 is arranged at the opposite side 32 of the valve body 3 and the second end 92 of the sealing 9 is arranged at the edge 6. This provides for receptacle with a more appealing look without compromising the function of the valve body 3.

Also, the receptacle body comprises two side sealings 10 and 11. The side sealings 10 and 11 extend in the embodiment shown from the outlet section 5 to the second edge 7 of the receptacle body. The side sealings 10 and 11 serve to attach the first layer of plastic foil 21 and the second layer of plastic foil 22 to one another. The valve body 3 is arranged in a distance from both side sealings 10 and 11.

As may be seen, the second layer of plastic foil 22 is provided with a cut-out exposing most of the part of the first layer of plastic foil 21 extending between the side sealings 10 and 11. This may be desired for aesthetic and sales- and marketing related reasons such as to display the contents of the receptacle more clearly to the consumer. By providing such a cut-out, rather than omitting the second layer of plastic foil 22 altogether the parts of the receptacle most prone to damage, namely the bottom and the parts near the side sealings, are still reinforced by means of the second layer of plastic foil 22. Furthermore, the part of the second layer of plastic foil 22 extending along the side sealings 10 and 11 also serve the purpose of providing a receptacle 102 which keeps standing upright, or in other words does not easily collapse, when it is no longer completely full.

Also, the receptacle 102 comprises a locking mechanism 4 adapted for locking the valve body in its open position. The locking mechanism 4 is arranged at a position on the valve body 3 at which a user should press on the valve body in order to force it into its open position.

The receptacle 102 shown in FIGS. 4 and 5 is suitable for being provided in the form of a stand-up bag, a stand-up pouch or a stand-up sachet of the type intended for storage in a standing position. Therefore, the receptacle 102 is provided with a bottom 13 comprising a gusset 14 and being shaped in a manner generally known within the art of stand-up bags—see for instance EP 1 162 152 A1.

The function of the valve body 3 and the receptacle 2 will now be described with reference to FIGS. 4 and 5.

With reference to FIG. 4, the valve body 3 is in its closed state, in which a substance contained in the internal chamber 15 may not flow through the valve body 3. In this state the valve body locks itself in the closed state when it is under influence of pressure exerted by a substance contained in the internal chamber, i.e. e.g. when the receptacle 102 is lying down or is turned partially or completely upside down.

In more detail, the pressure exerted by the substance contained in the internal chamber generally described forces the parts of the first element of plastic foil 33 and the second element of plastic foil 34 of the valve body 3 adjacent to the locking mechanism 4, and thus farther from the edge 6 of the outlet section 5, and with them the respective opposite sides of the first layer of plastic foil 21 of the receptacle body 2 away from one another. This in turn results in that the parts of the first element of plastic foil 33 and the second element of plastic foil 34 of the valve body 3 closer to the edge 6 of the outlet section 5, and with them the respective opposite sides of the first layer of plastic foil 21 of the receptacle body 2 are forced towards one another thereby forcibly closing the valve body 3. The valve body 3 is thus in a stable closed state.

With reference now to FIG. 5, the valve body 3 is in its open state, in which a substance contained in the internal chamber 15 may flow through the valve body 3 to be expelled from the receptacle. In this state the valve body is in a stable, open state when it is under influence of a pressure exerted by a user on the locking mechanism 4, or on the valve body 3 in embodiments with no locking mechanism.

In more detail, the pressure exerted by a user generally described overcomes the force exerted by the substance contained in the internal chamber and thus forces the parts of the first element of plastic foil 33 and the second element of plastic foil 34 of the valve body 3 adjacent to the locking mechanism 4, and thus more generally farther from the edge 6 of the outlet section 5, and with them the respective opposite sides of the first layer of plastic foil 21 of the receptacle body 2 towards one another. Thereby the locking mechanism, where provided for, is brought into engagement. The parts of the first element of plastic foil 33 and the second element of plastic foil 34 of the valve body 3 closer to the edge 6 of the outlet section 5, and with them the respective opposite sides of the first layer of plastic foil 21 of the receptacle body 2, are not affected by the force exerted by the user and are thus still forced towards one another thereby forcibly opening the valve body 3. Thereby the valve 3 is forcibly kept open by the user, who may then retrieve the substance from the receptacle. Thereby the substance contained in the receptacle 2 may leave the receptacle 102 in the direction indicated by the two arrows 36 and 37 on the valve body 3 and through the opening 35 in the valve body 3 at the edge 6 as shown on FIG. 5.

Figure 6:
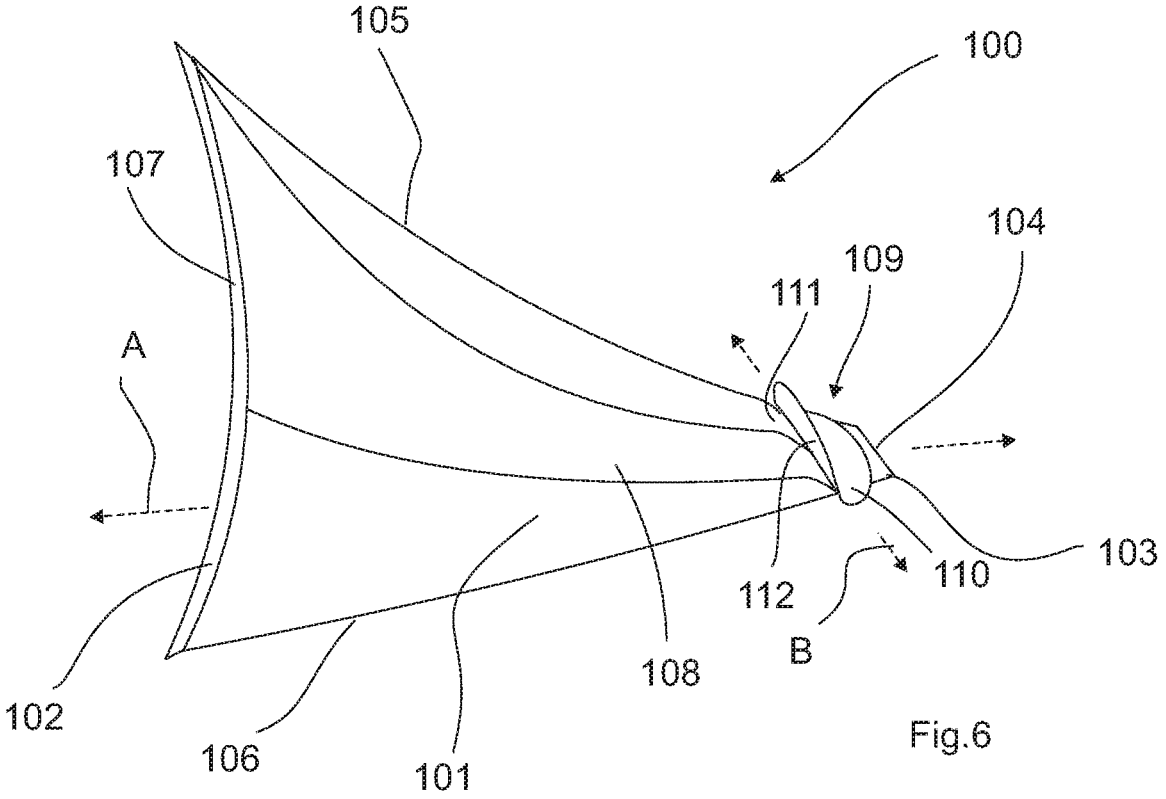
FIG. 6 shows a perspective view of a container.

FIG. 6 shows a perspective view from above of a container 100, where the container is made of a sheet material 101 having a bottom end 102 and a top end 103, where the top end comprises an opening 104 and the bottom end defines a closed end of the container. The sheet material 101 may be joined together at its edges 105, 106, 107 in order to define a compartment 108 to hold a fluid material. The container shown in FIG. 6 may be defined as being a container 100 adapted to hold a liquid, where the liquid may be introduced into the container 100 and is held inside the compartment 108. The view shown in FIG. 6 shows a container that is depicted as holding a liquid, where an empty container 100 would be relatively flat, where the sheet material on the side walls lies flat towards the opposite side wall of the container, similar to an empty plastic bag. The side walls may be constructed from any thermoplastic or plastic material, such as a PE plastic film, where the edges may be heat sealed together. The film material (sheet) may further be provided with a metal coating in order to provide a liquid and/or vapor tight barrier for the container.

The top end 103 may be provided with an opening 104, where this opening may be cut into the sheet material, and where the container 100 may have a heat sealed top end, which must be cut in order to have access to the opening 104. The container may be provided with a valve element 109, which may comprise a first flexible layer 110 that may be attached to the side wall 111 of the container. The attachment of the flexible layer 110 is shown more clearly in FIGS. 9 and 10. The flexible layer 110 is attached approximately at its midsection to the side wall 111, so that a distal end 112 of the flexible layer 110 is adapted to flex in a direction that is radial to the longitudinal axis A of the container 100, so that the flexible layer deflects along a transverse axis B. When the container is filled with a liquid and/or fluid, the container balloons up so that the side wall 111 of the container is pushed in a direction away from the longitudinal axis A and where the side wall 111 pushes the distal end 112 of the flexible layer 110 in the same direction, so that the flexible element deflects from its attachment on the container.

The container 100 shown in FIG. 6 is provided with an opening that has been cut from the top end between a valve element 109 and the top end 104.

Figure 7:
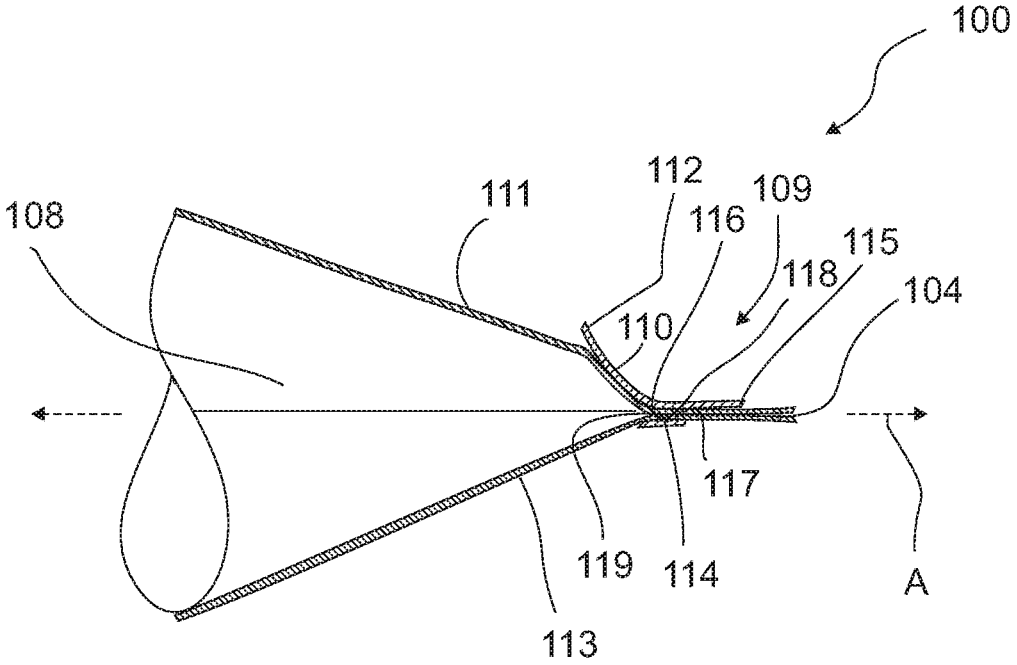
FIG. 7 shows a cross sectional view of one embodiment of a container comprising a valve.

FIG. 7 shows a cross sectional view of a container 100 in accordance with the invention, taken along the longitudinal axis A. The container 100 has a first side wall 111, and an opposite side wall 113, where the compartment 108 for holding the liquid and/or fluid is between the first side wall 111 and the second side wall 113. The valve element 109 comprises a first flexible material 110 and an opposing element 114, where the first flexible material 110 is attached to the sheet material and the opposing element 114, at a longitudinal position 116 between the distal end 112 and the proximal end 115 of the flexible material. The attachment is shown more clearly in FIGS. 9 and 10.

When the container 100 is filled with a fluid, the side walls 110 and 113 expand in a direction away from the longitudinal axis A of the container 100, creating a volume or compartment 108 to hold the liquid inside the container 100. The expansion of the side wall 111 pushes the distal end 112 of the flexible material 110 to follow the side wall 111, so that the flexible material 110 deflects along the axis B (not shown) which is perpendicular to the plane of the paper, where the lowest point of the deflection is in the position 116 where the flexible material is attached to the sheet material 111. The first flexible material 110 is further attached to an opposing valve element 114, through the first side wall 111 and the second side wall 113, in order to provide an opposing surface 117 to the inner surface 118 first flexible material 110.

When the flexible material 110 deflects in the manner shown in FIG. 7, the flexible material becomes more rigid along the axis B (shown in FIG. 6), ensuring that the lowest point of the deflection is maintained in close contact with the sheet material 111, 113 and the opposing valve element 114, ensuring that the opposing surface 117 and inner surface 118 do not move away from each other. Thus, the deflection of the first sheet material ensures that the sheet material 111 and 113, is maintained in close contact with each other, ensuring that a channel 119 made between the sheet materials is kept closed, and preventing any liquid and/or fluid inside the compartment to pass the valve element 109.

In order to open the valve element 109 shown in FIG. 7, the distal end 112 of the flexible material may be manually depressed in a direction towards the longitudinal axis of the container, allowing the deflection of the flexible material to reduce, and thereby reducing the rigidity of the flexible material along its transvers axis B. Thus when the deflection is reduced, the rigidity of the material decreases until it reaches a point where the rigidity of the flexible material in the direction of the transverse axis is lower than the rigidity along its longitudinal axis and the flexible material deflects in a direction along its transverse axis (perpendicular to the deflection of closure) and the pressure between the surface of the first material 118 and the surface 117 of the opposing element is reduced so that the channel 119 may be opened. This is shown more clearly in FIG. 9.

Figure 8:
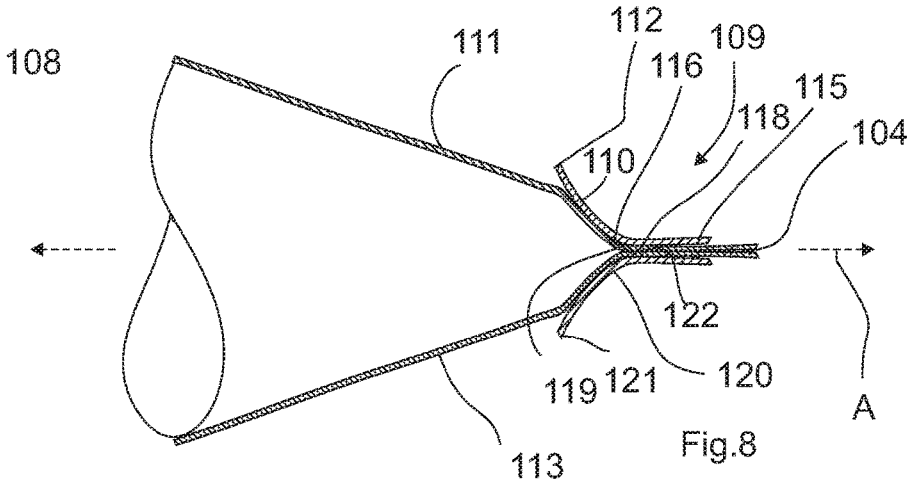
FIG. 8 shows a cross sectional view of a container having a second embodiment of a valve.

FIG. 8 shows an alternative embodiment of a container 150 in accordance with the invention, which is very similar to that shown in FIG. 7, and the same elements are shown using the same reference numbers. The container 150 differs from the container 100 shown in FIG. 7 in that the opposing element 114 in FIG. 7 has been replaced with a second layer of flexible material 120, which functions in a similar manner to the flexible material 110, where the second layer 120 operates in an opposite direction to that shown in FIG. 7. The second layer 120 is attached so that it opposes the first layer 110, in the position 109, where the distal end 121 of the second layer 120 is pushed in a direction away from the longitudinal axis A, causing the second layer 120 to deflect in the same manner as the first layer 110. Thus the inner surface 122 of the second layer opposes the inner surface of the first layer 118, where the rigidity of the first and second layer in the transverse direction B is high enough to ensure that the surfaces 122 and 118 are kept in close contact and wedging the channel 119 between them, and closing the channel 119.

Figure 9A:
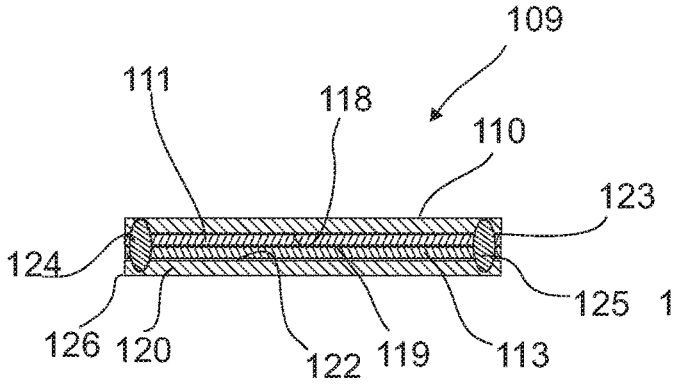
FIGS. 9*a* and 9*b* show a cross sectional view taken along the transverse axis of the container showing the valve in a closed state and an open state, respectively.
Figure 9B:
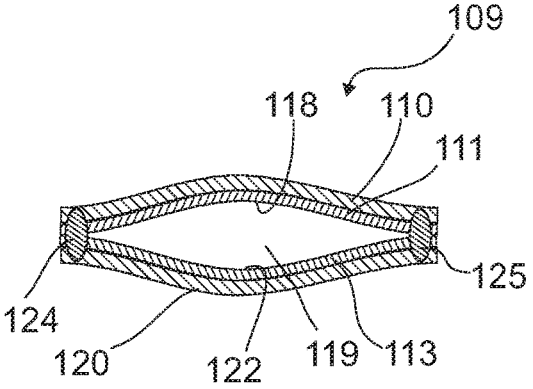

The channel may be opened by applying pressure to the distal end 112 of the first layer 110 and/or the distal end 121 of the second layer, so that the rigidity of the layers in the direction B is reduced and allows it to deflect, similar to that shown in FIG. 9*b*.

FIG. 9*a* shows a cross section of the container taken along the axis B, where the valve element 109 comprises a first flexible layer 110 and a second flexible layer 120. FIG. 9B shows the valve element in a closed state, where the inner surface 118 of the first flexible layer 110 is at the lowest point of the deflection and the inner surface 122 of the second flexible layer is at the lowest opposite point of the deflection. Thus, the rigidity of the flexible layer is maintained in the direction B, and presses the inner surface 118 in a direction towards the inner surface 122. Thus the channel 119 is wedged between the two layers 110 and 120, so that the channel is closed and does not allow fluid communication past the valve element in the longitudinal direction A (perpendicular to the paper).

FIG. 9*b* shows the same as FIG. 9*a*, where the deflection in the first flexible layer 110 and the second flexible layer 120 has been reduced, so that the rigidity in the direction B has been reduced significantly allowing the flexible materials 110 and 120 to deflect in the longitudinal direction, and thereby allowing the inner surface 118 to be moved away from the inner surface 122, allowing the channel 119 to open and allow fluid communication past the valve element 109.

The first layer 110 and the second layer 120 may be welded at the peripheral edges 123 and 124 of the container, where the welds 125 and 126 extend through the first layer 110, the first side wall 111, the second side wall 113 and the second layer 120, so that the four layers are attached to each other at the peripheral edge. Thus, the welds may be seen as limiting the cross sectional diameter of the channel 119, but allows the first side wall 111 to move away from the second side wall 113 in an area between the first weld 125 and second weld 126.

Figure 10A:
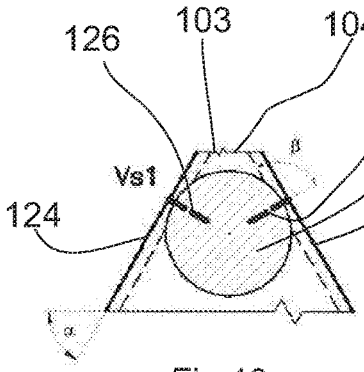
FIG. 10*a-c* shows different types of valve mechanism for containers.
Figure 10B:
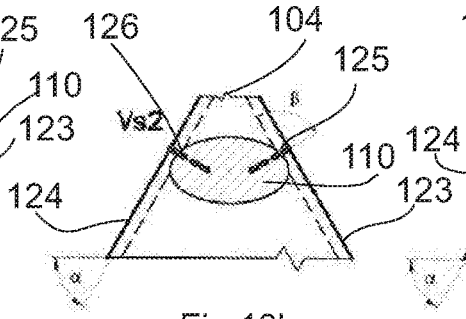
Figure 10C:
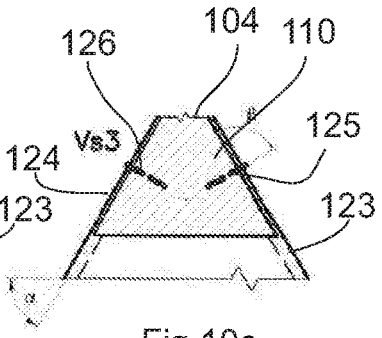

FIG. 10*a-c* shows a top view of an opening end 103 of a container in accordance with the invention, where the opening end 103 is provided with an opening 104 and where the peripheral edges 161, 162 of the container are at an angle $\alpha$ from a transverse axis of the container 100. The angle $\alpha$ may be seen as being $90°-\alpha$ from the longitudinal axis, which is perpendicular to the transverse axis. The flexible layer 110 is shown in different shapes in the Figs. where FIG. 10*a* shows a circular flexible layer, FIG. 10*b* shows an elliptical flexible layer and FIG. 10*c* shows a trapezoidal shape.

The first layer 109 may be welded to the container using welds 125 and 126 positioned close to the peripheral edge 123 and 124 of the container, where the welds extend inwards at an angle $\beta$ relative to the peripheral edges 123 and 124 of the container. The angle $\beta$ may be substantially 90°, but may be anywhere between 45° and 135°, in order to reduce the diameter of the channel. The weld 125,126 may extend through all the layers of the container, similar to that shown in FIG. 9.

Figure 11:
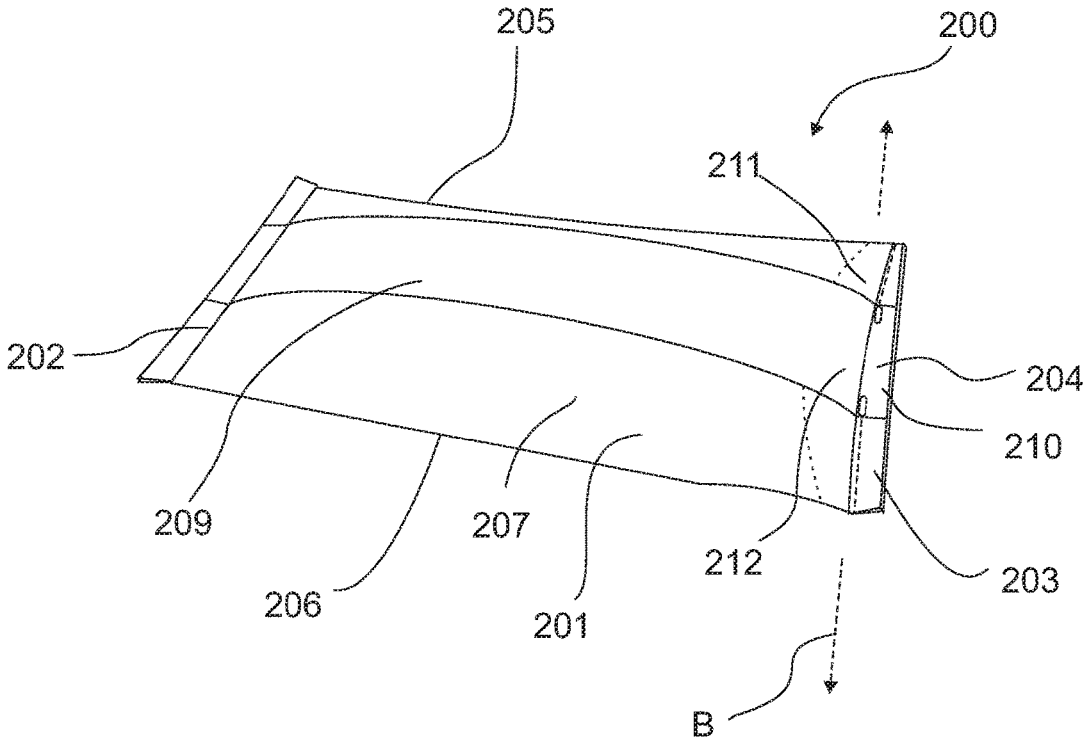
FIG. 11 shows a perspective view of an alternative container.

FIG. 11 shows a container 200 in accordance with the invention, where the container 200 comprises a sheet material 201, having a bottom end 202 and a top end 203, where the top end 203 comprises an opening 204 and the bottom end 202 defines a closed end of the container 200. The sheet material 201 is arranged in a substantially rectangular shape, where the top end 203 and the bottom end 202 define opposite sides of the shape and where the peripheral edges 205, 206 of the container define opposite sides of the container. The container 200 may be filled with a fluid, such as a liquid, where the fluid causes the container to fill up and balloon or bulge up, causing the side walls of the container to move away from each other. The bottom end 202 and the top end 203, as well as the side edges, operate as anchor points for the ballooning, where the side walls of the container may be joined together. Thus, the areas of the side walls 207 of the container, that are in the vicinity of the ends, deforms and cause the side wall to slope downwards in the direction from the center of the container 200 towards the joined edges or folds.

The container 200 may be provided with a strip 209 of flexible layer, where the flexible material 209 may be attached at the bottom end 202 and the top end, where the flexible material may extend from one extreme end of the container to the opposite extreme end of the container. In the bottom end the strip 209 may be attached along its entire width, by joining it to the sheet material by welding, adhesion, etc. At the opposite end, the top end 203, the top end 210 of the strip overlaps the opening 204 of the container 200, where the strip may be attached at its sides by welding the sides 214,215 of the strip to the container on opposite sides, so that the welds 216, 217 cause a constriction in the opening 204 (or the channel of the opening). The welds 216, 217 ensure that the strip 209 is attached parallel to the sheet material, so that the strip (i.e. the valve element) is capable of deflecting so that the flexible material 209 becomes rigid along the axis B. Thus, when the container 200 is filled with a fluid, the distal end 212 of the strip follows the contour of the side walls, causing the strip to deflect along the axis B, and causing the strip to become more rigid along the transverse axis B.

In this embodiment, the container 200 may be provided with an opposite strip, that is position on the opposite side of the container, or it may be provided with a valve element, that ensures that when the strip 209 is deflected as seen in FIG. 11 the rigidity of the sheet material ensures that the opening 204 is closed. The embodiment shown in FIG. 11 functions in a similar manner to the embodiments shown in FIG. 6-10, which means that the functionality of the valve mechanism and container previously disclosed applies equally to the embodiment shown in FIG. 11.

Figure 12:
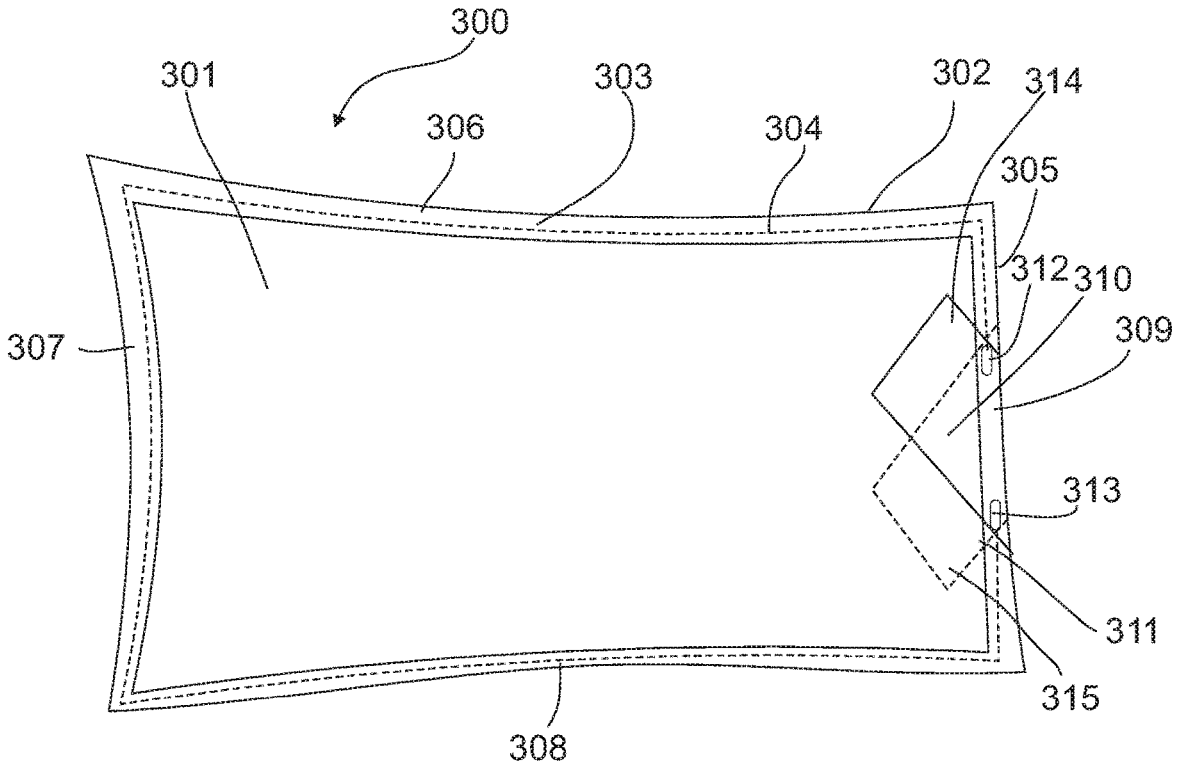
FIG. 12 shows a top view of a container having a valve, where the valve members are asymmetric on opposite sides of the opening.

FIG. 12 shows another embodiment of a container 300 in accordance with the invention. The container comprises a first sheet material 301 and a second sheet material 302 that are welded together at the periphery 303 using a welding seam 304 that extends along the peripheral edge of the container 300 from the first end 305, along the first lateral edge 306 and towards the second end 307, towards the second peripheral edge 308 towards the first end 305. Thus, the welding seam 304 of the first 301 and second sheet material 302 defines a compartment between the sheet material. The container 300 comprises an opening 309, which is positioned in the first end 305, where the opening may be seen as an area of the periphery of the container 300 where the first 301 and second sheets 302 are not welded together, and provide a fluid communication between the compartment and the surroundings.

The container further comprises a first flexible material 310, which is positioned on a first outer surface of the sheet material and a second flexible material 311, which is positioned on the outer surface of the opposite sheet material, where the first 310 and second 311 flexible materials overlap each other in the area of the opening 309 of the container 300. The first and second flexible materials are attached to the container using a first 312 and a second attachment 313, i.e. welds, where the first and second attachments may be integral with the peripheral welding seam 304 or may be separately provided.

In the embodiment shown in FIG. 12, the first flexible material 310 and the second flexible material 311 are provided so that only parts of the flexible material overlap each other, and are provided in an asymmetrical manner along the longitudinal central axis of the container. The first flexible material 311 is provided so that the first end 314 extends diagonally from the opening and towards the side edge of the container. Thus, when the first end 314 is deflected in a direction away from the longitudinal central axis, when the container is filled with fluids, the force of the deflection in the area of the opening may be seen as being uneven from one peripheral side of the opening 309 to the other, i.e. in the area between the attachment means 312, 313.

On the opposite side of the container, a second flexible material 312 is provided in a similar manner, where the first end 315 extends diagonally from the opening and towards the opposite side edge of the container 300, and operates in a similar manner to the first flexible material, as it may be seen as being positioned in a mirrored position to the first material.

Thus, when the first end 314 of the first flexible material 310 and the first end 315 of the second flexible material 311 are deflected in opposite directions away from the longitudinal central axis, the force applied across the opening may be seen as being distributed differently from one flexible material 310 to the other 311, and the force is not even from one attachment means 312 to the other 313. But as the opposing flexible materials may be seen as mirrored to each other, the resulting force using both flexible materials appears to be even.

In a few preliminary tests, the inventors have shown that providing the first and second material in an asymmetrical and/or mirrored position to each other and/or across the longitudinal central line, as shown e.g. in FIG. 12, provides an increased closing force of the valve across the opening, which means that the container can withstand a higher pressure inside the compartment without resulting in the opening being compromised and ensuring that the deflection of the flexible material maintains the pressure of the first flexible material and the second flexible material in the area of the opening for longer, facing higher pressures from the inside of the compartment 300.

It should be noted that the above description of preferred embodiments serves only as examples, and that a person skilled in the art will know that numerous variations are possible without deviating from the scope of the claims.

The person skilled in the art realizes that the present invention by no means is limited to the preferred embodiments described above. On the contrary, many modifications and variations are possible within the scope of the appended claims. Particularly, the various elements and features of the various embodiments described herein may be combined freely.

[Embodiments]

1. A receptacle comprising: a receptacle body comprising a first layer of plastic foil, the receptacle body further comprising a longitudinal direction, a transversal direction, an internal chamber and an outlet section, the outlet section comprising a first side edge and a second side edge, and a valve body which is arranged at the outlet section and in a distance from both the first side edge and the second side edge of the outlet section seen in the transversal direction, wherein the valve body comprises a higher stiffness than the receptacle body, the valve body comprises a first element of plastic foil and a second element of plastic foil arranged on mutually opposite sides of the first layer of plastic foil, the first element of plastic foil and the second element of plastic foil comprising a higher stiffness than the receptacle body, the first element of plastic foil of the valve body and the second element of plastic foil of the valve body being attached to the receptacle body by means of two sealings, the valve body comprises an open state and a closed state such that the valve body closes off the access to the internal chamber of the receptacle body in the closed state and allows a substance contained in the internal chamber of the receptacle body to exit the receptacle in the open state, and the valve body is adapted for being stable in both the open state and the closed state.

2. A receptacle according to embodiment 1, wherein the outlet section comprises an edge opposite to the internal chamber, wherein the two sealings attaching at least the first element of plastic foil of the valve body to the receptacle body each comprise a first end and a second end, wherein the respective first ends of the two sealings are located farther or in the same distance from the edge of the outlet section than or as the respective second ends and wherein the distance between the two sealings measured between the respective first ends is smaller than or equal to the distance between the two sealings measured between the respective second ends.

3. A receptacle according to embodiment 1 or 2, wherein the receptacle body further comprises a second layer of plastic foil, wherein the first layer of plastic foil provides an inner layer of the receptacle body and the second layer of plastic foil provides an outer layer of the receptacle body, and wherein the second layer of plastic foil comprises a higher stiffness than the first layer of plastic foil.

4. A receptacle according to embodiment 3, wherein the valve body comprises a higher stiffness than both the first layer of plastic foil and the second layer of plastic foil of the receptacle body.

5. A receptacle according to any one of the above embodiments, wherein the valve body comprises a stiffness that is at least 5%, at least 10%, at least 20% or at least 30% higher than the stiffness of the first layer of plastic foil.

6. A receptacle according to any one of the above embodiments, wherein the outlet section is tapered in the longitudinal direction of the receptacle body.

7. A receptacle according to any one of the above embodiments, wherein the receptacle body comprises two mutually opposite side sealings.

8. A receptacle according to any one of the above embodiments, wherein the two sealings attaching the first element of plastic foil of the valve body and the second element of plastic foil of the valve body to the receptacle body are any one of welds and adhesive bondings.

9. A receptacle according to any one of the above embodiments, wherein the receptacle body comprises a tamper evident feature extending at least partially between the valve body and an edge of the outlet section of the receptacle body opposite to the internal chamber as seen in the longitudinal direction.

10. A receptacle according to any one of the above embodiments, wherein the valve body comprises a locking mechanism adapted for locking the valve body in the open position.

By providing a valve body comprising a first element of plastic foil and a second element of plastic foil arranged on mutually opposite sides of the first layer of plastic foil, the first element of plastic foil and the second element of plastic foil comprising a higher stiffness than the receptacle body, the first element of plastic foil of the valve body and the second element of plastic foil of the valve body being attached to the receptacle body by means of two sealings, a valve body with a particularly simple structure being easy and cheap to manufacture is provided for, particularly as the receptacle in its entirety may be made out of plastic foil. Furthermore such a valve ensures that the receptacle takes up very little space during transport and storage as the valve is substantially tight thus not allowing air to enter the receptacle and as the receptacle is collapsible in its entirety when empty.

The first element of plastic foil and the second element of plastic foil may be attached to the first layer of plastic foil of the receptacle body on mutually opposite sides thereof, particularly on mutually opposite outer sides of the receptacle body.

By providing a valve body with a higher stiffness than the receptacle body, it is ensured that a relatively high pressure on the valve body is needed in order to bring it to its open position. This in turn ensures that the valve is very tight and that a substance contained in the receptacle is not spilled when the valve is in its closed position.

Arranging the valve body at the outlet section and in a distance from both the first side edge and the second side edge of the outlet section, and thus substantially centrally on the receptacle body seen in the transversal direction, contributes to the abovementioned effects, and in particular to the tightness of the valve, and furthermore ensures that the valve and thus the receptacle is particularly simple and effective in use.

By providing a valve body being adapted for comprising an open state and a closed state such that the valve body closes off the access to the internal chamber of the receptacle body in the closed state and allows a substance contained in the internal chamber of the receptacle body to exit the receptacle in the open state, and furthermore being adapted for being stable in both the open state and the closed state, a valve body is provided with which a substance may be kept safely contained in the internal chamber in a substantially spill-free manner during transport and storage of the container, and with which the substance may be expelled from or poured out of the receptacle in an easy and straightforward manner when and where it is desired. Such a valve may be said to be bistable.

Furthermore, the provision of a valve body comprising at least a first element of plastic foil makes it possible to make the entire receptacle in plastic foil, and thereby firstly to make the receptacle very light, by way of comparison as light as ⅕ to 1/10 of the weight of existing bottles for water and/or soft drinks, and secondly to make the receptacle e.g. in a biodegradable material and/or in a non-toxic material suitable for e.g. foodstuffs.

As used herein, the term stiffness is intended to mean that the stiffness of a particular element is influenced both by Young's modulus, E, of the material of the element and by the thickness of the particular element. Thus, the stiffness of one element of the receptacle may be made higher than the stiffness of another element of the receptacle by choosing a material for the one element having a higher Young's modulus than the material of the other element of the receptacle and/or by simply making the material of the one element of the receptacle thicker than the material of the other element of the receptacle. Thus, e.g. the stiffness of the valve body may be made higher than the stiffness of the first layer of plastic foil by choosing a material for the valve body having a higher Young's modulus than the material of the first layer of plastic foil and/or by simply making the material of the valve body thicker than the first layer of plastic foil.

Thus, in an embodiment, the valve body, or more particularly the first element of plastic foil of the valve body and the second element of plastic foil of the valve body, comprises any one or more of a material with a higher Young's modulus, E, than the first layer of plastic foil and a higher thickness than the first layer of plastic foil.

In an embodiment, the outlet section comprises an edge opposite to the internal chamber, the two sealings attaching at least the first element of plastic foil of the valve body to the receptacle body each comprise a first end and a second end, the respective first ends of the two sealings are located farther or in the same distance from the edge of the outlet section than or as the respective second ends and the distance between the two sealings measured between the respective first ends is smaller than or equal to the distance between the two sealings measured between the respective second ends.

In an embodiment, the two sealings attaching at least the first element of plastic foil of the valve body to the receptacle body extend in an angle $\alpha$ of from 0° to 180°, from 20° to 180°, from 20° to 160° or about 120° with respect to one another.

Either of these two embodiments provides for a receptacle which by way of experiments has been shown to be particularly tight and thus particularly well secured against leaks when the valve is closed.

In an embodiment, the receptacle body further comprises a second layer of plastic foil, the first layer of plastic foil provides an inner layer of the receptacle body and the second layer of plastic foil provides an outer layer of the receptacle body, and the second layer of plastic foil comprises a higher stiffness than the first layer of plastic foil.

Thereby, a receptacle having a receptacle body with a more robust and sturdy structure is provided for, thus lowering the risk of damage to the receptacle body. Such a receptacle body structure is furthermore particularly well suited for stand-up receptacles.

In a further embodiment, the receptacle body may comprise a plurality, i.e. three or more, layers of plastic foil.

The layers of plastic foil of the receptacle body may have different properties such as, but not limited to, being impermeable to water, liquid, fluid or gas or being adapted to protect the contents of the internal chamber against sunlight and/or artificial light or specific types of radiation, e.g. UV light.

In an embodiment, the valve body comprises a higher stiffness than both the first layer of plastic foil and the second layer of plastic foil of the receptacle body.

Thereby, a tight and robust valve is ensured for receptacles with a receptacle body comprising a second layer of plastic foil.

In an embodiment, the valve body comprises a stiffness that is at least 5%, at least 10%, at least 20% or at least 30% higher than the stiffness of the first layer of plastic foil.

Either of these two embodiments provides for a receptacle which by way of experiments has been shown to be particularly tight and thus particularly well secured against leaks when the valve is closed, and which furthermore is particularly well functioning when it is desired to retrieve the substance contained in the receptacle.

In an embodiment, a further sealing is provided, the further sealing extending from the valve body towards an edge of the outlet section of the receptacle body opposite to the internal chamber as seen in the longitudinal direction.

Such a further sealing has been shown to improve both the tightness of the valve body when closed and the function of the valve body when it is desired to open it. Furthermore, such a further sealing adds to the robustness of the attachment of the valve body to the receptacle body.

In an embodiment, the outlet section is tapered in the longitudinal direction.

Such a structure has been shown to contribute to the tightness of the valve body due to the pressure excreted by the substance contained in the receptacle body on the valve body being more concentrated on the valve body.

In an embodiment, the receptacle body comprises two mutually opposite side sealings.

Thereby, a more robust receptacle is provided for, especially when the receptacle body comprises both a first and a second layer of plastic foil, in which case the side sealings may attach the first and second layer of plastic foil to one another.

In a further embodiment, the valve body is arranged at the outlet section and in a distance from both of the two mutually opposite side sealings of the receptacle body.

In an embodiment, the receptacle body comprises a tamper evident feature extending at least partially between the valve body and an edge of the outlet section of the receptacle body opposite to the internal chamber as seen in the longitudinal direction.

The tamper evident feature may e.g. be a tearable or cuttable section.

Such a tamper evident feature serves to further improve the tightness of the receptacle during transport and storage and simultaneously to facilitate correct opening of the receptacle when access to the substance contained therein is desired.

In an embodiment, the valve body comprises a locking mechanism adapted for locking the valve body in the open position.

In another embodiment, the receptacle comprises a locking mechanism adapted for locking the valve body in the open position.

Such a locking mechanism provides for a receptacle being very easy to empty and is thus particularly advantageous in case of receptacles with a large internal volume.

Such a locking mechanism may be any suitable locking mechanism, but is preferably a releasable locking mechanism. One non-limiting example is a snaplocking locking mechanism.

In an embodiment, the valve body comprises two opposite sides and the two sealings attaching the first element of plastic foil and the second element of plastic foil of the valve body to the receptacle body extend at, from and/or adjacent to the two opposite sides of the valve body. Thereby a particularly tight and well-functioning valve is obtained.

In an embodiment, the first layer of plastic foil is a double layer.

In an embodiment, the second layer of plastic foil is a double layer.

These two embodiments each provide for a receptacle with a receptacle body having an improved robustness and strength.

The receptacle body may in principle take up any shape, non-limiting examples being substantially tubular, conical or shapes with a plurality of side surfaces of identical or different surface shape.

The two sealings attaching the first element of plastic foil and the second element of plastic foil of the valve body to the receptacle body, the further sealing where present and the two side sealings where present may be any suitable type of sealing, and are in one embodiment provided as any one of welds and adhesive bondings.

In an embodiment, the first layer of plastic foil and/or, where present, the second layer of plastic foil is provided as any one of a tubular and a U-shaped plastic foil.

In an embodiment, the first layer of plastic foil and/or, where present, the second layer of plastic foil is a polyolefin, such as a polypropylene or a polyethylene.

In an embodiment, the first layer of plastic foil and/or, where present, the second layer of plastic foil is a plastic material suitable for or approved for storing foodstuffs, cosmetics, pharmaceutical products and/or body care products.

In an embodiment, the first and/or second element of plastic foil of the valve body is made of polyolefin, such as a polypropylene or a polyethylene.

In an embodiment, the first and/or second element of plastic foil of the valve body is made of a plastic material suitable for or approved for storing foodstuffs, cosmetics, pharmaceutical products and/or body care products.

Furthermore, the receptacle according to the invention may be any one of a bag, a pouch, a sachet, a stand-up bag, a stand-up pouch and a stand-up sachet.

In an embodiment, the receptacle is adapted for containing foodstuffs, cosmetics, pharmaceutical products or body care products.

Also, the receptacle may be a reusable receptacle or a disposable receptacle.

The present invention further relates to a use of a receptacle according to the invention for storing or holding liquids or fluids and particularly liquids and fluids such as foodstuffs, pharmaceutical products, cosmetics or body care products.

The person skilled in the art will recognize that any feature of the embodiments disclosed above may be included in any of the other alternative embodiments of the invention.

What is claimed is:

1. A container comprising:

at least one first layer of sheet material defining at least partly a compartment for holding a fluid material, a first peripheral edge for defining a first lateral boundary of the compartment, a second peripheral edge for defining a second lateral boundary of the compartment, a first end comprising an area defining an opening end and a channel having a first cross sectional diameter extending along a longitudinal axis into the compartment between the first peripheral edge and the second peripheral edge, the open end being provided with an opening, a second end adapted to be closed defining a bottom of the compartment, a valve means for providing an automatic liquid stop for the opening into the compartment, wherein the valve means comprises:

a first layer of flexible material on a first side of the channel, wherein the first layer of flexible material comprises a material that has a higher stiffness than the sheet material defining the compartment and wherein the first layer of flexible material includes a distal end, and a second layer of flexible material on a second side of the channel, wherein the second layer of flexible material comprises a material that has a higher stiffness than the sheet material defining the compartment and wherein the second layer of flexible material includes a distal end, wherein the distal ends of the first and second layers of flexible material are flexed in opposing directions away from the longitudinal axis when the compartment is filled with the fluid material, causing a deflection of each of the first and second layers of flexible material in a direction that extends substantially perpendicular to the longitudinal axis, wherein the first and second layers of flexible material are joined on opposite sides of the channel via a first and a second attachment means that are adapted to restrict the first cross sectional diameter of the channel, wherein the deflection of the first and second layers of flexible material provides an increased resistance to a deflection of the first and second layers of flexible material in a direction along the longitudinal axis, so that the deflection of the first and second layer of flexible material provides pressure of the first and second layer of flexible material towards each other to prevent fluid communication from the compartment to the opening end, wherein the first layer of flexible material and the second layer of flexible material overlap each other and are substantially parallel when the container is empty, and wherein manual depression of the distal ends of the first and second layers of flexible material in a direction towards each other and towards the longitudinal axis reduces the deflection of the first and second layers of flexible material, whereby the pressure between the first and second layers of flexible material is reduced so that the channel is reopened.

2. The container in accordance with claim 1, wherein the first and second attachment means are adapted to extend inwards towards the longitudinal axis from the first peripheral edge and the second peripheral edge, respectively.

3. The container in accordance with claim 1, where the first and second attachment means are in the form of a weld, an adhesion or a clamp.

4. The container in accordance with claim 1, wherein the first and second attachment means provides an increased strength and/or stiffness to the first layer of flexible material and the second layer of flexible material.

5. A container in accordance with claim 1, wherein the channel is provided between the first layer of flexible material and the second layer of flexible material.

6. A container in accordance with claim 1, wherein the deflection of the first layer of flexible material and the second layer of flexible material is proximal to the first and second attachment means in a direction towards the second end of the container.

7. A container in accordance with claim 1, wherein the first and second peripheral edges of the container are adapted to be angled toward each other, wherein the angle is converging towards the first end of the container.

8. A container in accordance with claim 1, wherein the first and second attachment means are at an angle respective to the direction of deflection of the first layer of flexible material.

9. A container in accordance with claim 1, wherein the first layer of flexible material is a strip that extends from the first end toward the second end of the container.

10. A container in accordance with claim 1, wherein at least one of the first layer of flexible material and the second layer of flexible material has a varying thickness in a direction along the longitudinal axis of the container.

11. A container in accordance with claim 1, wherein at least one of the first layer of flexible material and the second layer of flexible material has a thickness that is greater in an area where the pressure is provided between the first and second layers of flexible material to prevent fluid communication between the compartment and the opening end.

* * * * *